US005961864A

United States Patent [19]

Nakajima et al.

[11] Patent Number: 5,961,864

[45] Date of Patent: Oct. 5, 1999

[54] TONER IMAGE HEATING DEVICE

[75] Inventors: Isao Nakajima; Akihiko Yamazaki; Akitomo Kuwabara; Yoji Hirose; Hidefumi Ohtsuka; Hiromitsu Fukuda, all of Ibaraki, Japan

[73] Assignee: Hitachi Koki Co., Ltd., Tokyo, Japan

[21] Appl. No.: 09/071,940

[22] Filed: May 5, 1998

[30] Foreign Application Priority Data

May 9, 1997 [JP] Japan ..... 9-119612
Mar. 19, 1998 [JP] Japan ..... 10-070608

[51] Int. Cl.[6] ..... G03G 15/20

[52] U.S. Cl. ..... 219/216; 219/470; 399/334

[58] Field of Search ..... 219/216, 469, 219/470; 399/69, 329, 330, 331

[56] References Cited

U.S. PATENT DOCUMENTS 4,618,240 10/1986 Sakurai et al. ..... 219/216
4,825,242 4/1989 Elter ..... 399/67
5,041,718 8/1991 d'Hondt et al. ..... 219/255
5,223,901 6/1993 Endo et al. ..... 399/334
5,450,181 9/1995 Tsukida et al. ..... 219/216
5,517,293 5/1996 Tonai et al. ..... 399/331
5,689,789 11/1997 Moser ..... 399/331
5,708,949 1/1998 Kasahara et al. ..... 399/330
5,778,294 7/1998 Hiraoka et al. ..... 399/329
5,862,436 1/1999 Ishizawa et al. ..... 399/69

*Primary Examiner*—Joseph Pelham
*Attorney, Agent, or Firm*—Sughrue, Mion, Zinn, Macpeak & Seas, PLLC

[57] ABSTRACT

A toner image heating device for heating a recording material holding a toner image includes: a first heating roller having a plurality of heaters which are different in heat generating region from one another; and a second heating roller having a plurality of heaters which are different in heat generating region from one another. A heat generating region dividing position between said heaters adjacent to each other in said second heating roller is shifted from a heat generating region dividing position between said heaters adjacent to each other in said first heating roller.

10 Claims, 4 Drawing Sheets

TONER IMAGE HEATING DEVICE

BACKGROUND OF THE INVENTION

1. Field of the Invention

This invention relates to a toner image heating device which heats a recording material holding a toner image.

2. Description of the Related Art

In general, a toner image heating device adapted to fixing or temporarily fixing a toner image on a recording material such as sheet, is as follows: In one example of the device, a recording material is heated according to a flash fixing system or oven fixing system, so that a toner image is fixed onto the recording material. In another example of the device, a heat roller fixing system in which a heating roller with a heat source and a pressing roller having no heat source are abutted against each other is employed so that a recording material is conveyed while being heated and pressed, whereby the toner image is fixed on the recording material.

A toner image heating device-of this type is employed for a printer or the like which records an image according to a well-known electro-photographic process. As it is required to increase the printing speed of the printer, recently it has become difficult to sufficiently heat the recording material which is conveyed at high speed.

SUMMARY OF THE INVENTION

An object of the invention is to provide a toner image heating device which, in each of the front and rear surfaces of a recording material, corresponds the heating region to the size of a given recording material.

The foregoing object of the invention has been achieved by the provision of a toner image heating device for heating a recording material holding a toner image, which, according to the invention, includes: a first heating roller having a plurality of heaters which are different in heat generating region from one another; and a second heating roller having a plurality of heaters which are different in heat generating region from one another, wherein a heat generating region dividing position between said heaters adjacent to each other in said second heating roller is shifted from a heat generating region dividing position between said heaters adjacent to each other in said first heating roller.

BRIEF DESCRIPTION OF THE DRAWINGS

Similar reference characters denote corresponding features consistently throughout the attached drawings. The preferred embodiments of this invention will be described in detail, with reference to the following figures, wherein.

DETAILED DESCRIPTION OF THE PREFERRED EMBODIMENTS

Preferred embodiments of the invention will be described with reference to the accompanying drawings.

Figure 7:
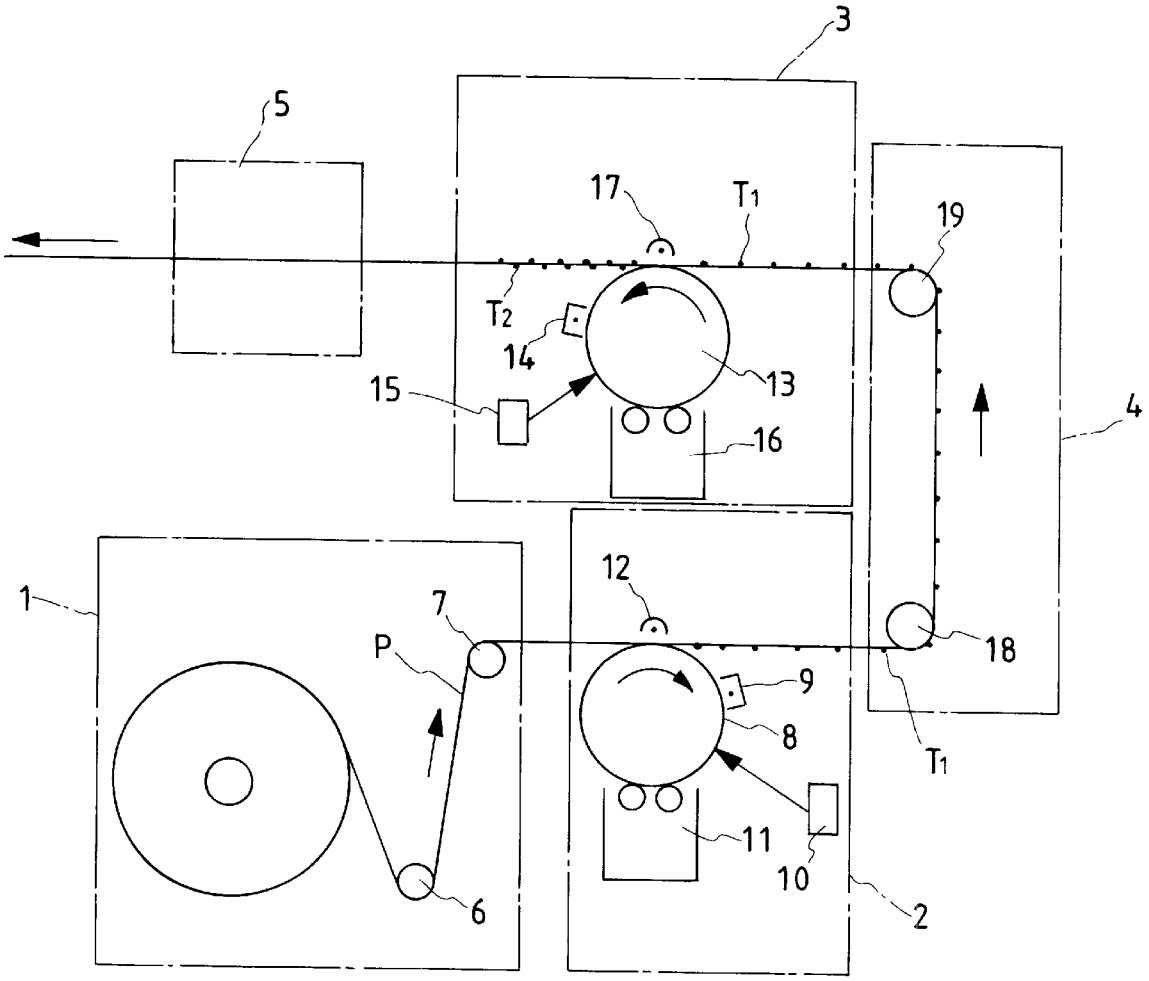
FIG. 7 is a diagram outlining the arrangement of a printer to which the toner image heating device of the invention is applied.

In this connection, it should be noted that in the embodiments, the technical concept of the invention is applied to a printer which uses a continuous sheet as a recording material as shown in FIG. 7.

As shown in FIG. 7, the printer includes a sheet supply section 1, image forming sections 2 and 3, a direction changing section 4 which changes the direction of conveyance of a recording sheet, and a toner image heating section 5.

The sheet supply section 1 has a roll sheet which is formed by winding a continuous sheet P in the form of a roll, and sheet guide rollers 6 and 7 adapted to guide and convey the sheet P to the image forming section 2. In the embodiment, the roll sheet is employed; however, the invention is not limited thereto or thereby; that is, for instance, a so-called "fan-fold sheet" may be employed which is folded back and forth at predetermined intervals. In the case where the fan-fold sheet is employed, instead of the sheet guide rollers 6 and 7, well-known sheet conveying tractors may be employed.

The image forming section 2 includes well-known elements for performing an electro-photographic process, such as a photo-sensitive drum 8, a charger 9, a exposure unit 10, a developing unit 11, and a transferring unit 12. The image forming section 3 also includes well-known elements for performing an electro-photographic process, such as a photosensitive drum 13, a charger 14, a exposure unit 15, a developing unit 16, and a transferring unit 17.

The direction changing section 4 includes sheet guide rollers 18 and 19 to lead the sheet P to the image forming section 3 which has been conveyed from the image forming section 2. The arrangement of the toner image heating section 5 will be described later in detail.

In the above-described printer, the sheet P supplied from the sheet supply section 1, being guided by the guide rollers 6 and 7, is conveyed into the image forming section 2, and passes through the photo-sensitive drum 8 and the transferring unit 12, so that a first toner image $T_1$ is transferred onto the sheet P. That is, the sheet P electrostatically holds the toner image $T_1$. The sheet P holding the toner image $T_1$ passes through the direction changing section 4, and is then delivered into the image forming section 3. In the section 3, the sheet P passes through the photo-sensitive drum 13 and the transferring unit 17, so that a second toner image $T_2$ is transferred onto the sheet P.

The sheet P, on both sides of which the toner images have been transferred, is delivered into the toner image heating section 5, where the sheet P is heated or heated and pressed, so that the toner images $T_1$ and $T_2$ are fixed on the sheet P.

In the case of FIG. 7, the image forming sections 2 and 3 record toner images in a single color on the front and rear surfaces of the sheet P, respectively; however, the invention is not limited thereto or thereby. That is, if a plurality of image forming sections are provided on the sheet path between the sheet guide roller 7 and the sheet guide roller 18 in such a manner that they are adjacent to the image forming section 2, then toner images can be recorded in more than one color on the first surface of the sheet P. Similarly, if a plurality of image forming section are provided on the sheet path between the sheet guide roller 19 and the toner image heating section 5 in such a manner that they are adjacent to the image forming section 3, then toner images can be recorded in more than one color on the second surface of the sheet P.

Now, the arrangement of the toner image heating section 5 will be described.

Figure 1:
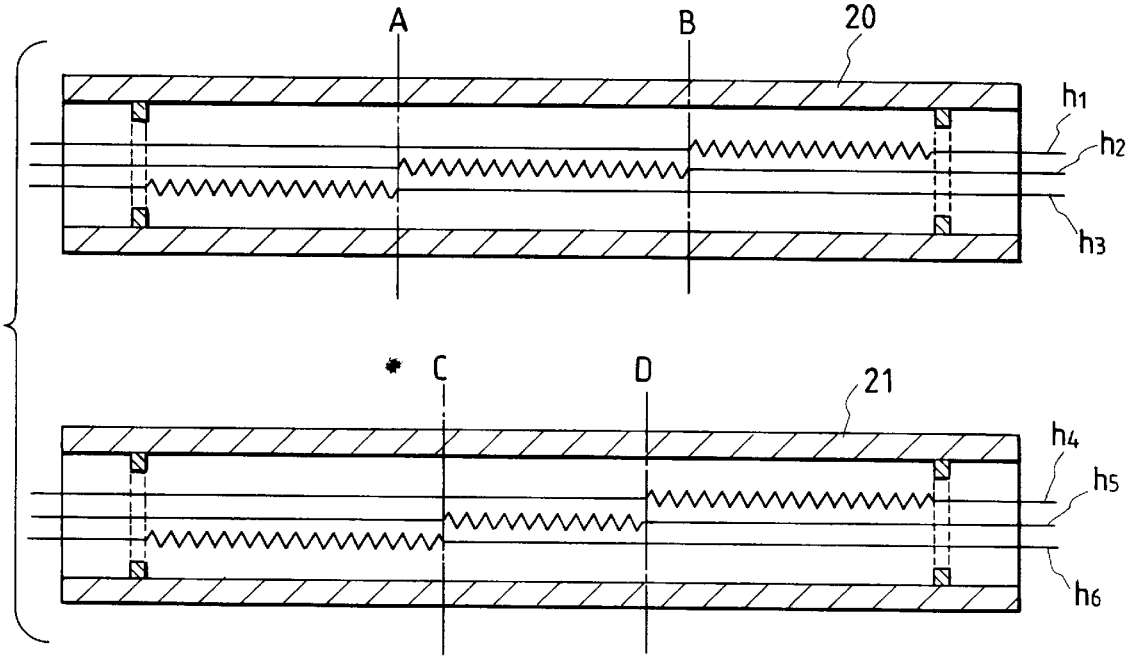
FIG. 1 is a sectional view showing heating rollers employed in a toner image heating device according to the invention.

In the device of the invention, the toner image heating section 5 includes: as shown in FIG. 1, a first heating roller which has a plurality of heaters (halogen lamps, or the like) $h_1$, $h_2$ and $h_3$ which are different in heat generating region from one another; and a second heating roller which has a plurality of heaters $h_4$, $h_5$ and $h_6$ which are also different in heat generating region from one another. The heat generating region dividing positions C, D of the second heating roller 21 are shifted from the heat generating region dividing position A, B of the first heating roller 20.

Now, the embodiments employing the heating rollers 20 and 21 will be described.

First Embodiment

Figure 2:
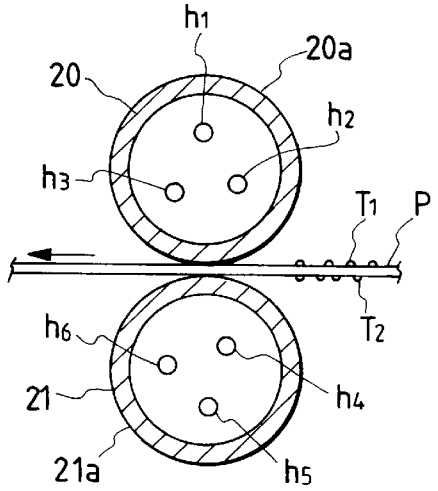
FIG. 2 is a side view showing an example of the toner image heating device, which constitutes a first embodiment of the invention.

FIG. 2 shows the heating rollers 20 and 21 which are pressed against each other through the sheet P. In this case, similarly as in the case of the well-known heat roller fixing system, the sheet P holding the toner image $T_1$ and the toner image $T_2$ is conveyed and heated while passing through the heating rollers 20 and 21, so that the toner images $T_1$ and $T_2$ are fixed onto the sheet P at the same time. In the case where the heating rollers 20 and 21 are pressed against each other as shown in FIG. 2, in order to smoothly release the toner images from the heating rollers it is preferable that release layers 20*a* and 21*a*, such as well-known fluoro-resin layers (PFA and FEP) are formed on the cylindrical surfaces of the rollers 20 and 21.

Second Embodiment

Figure 3:
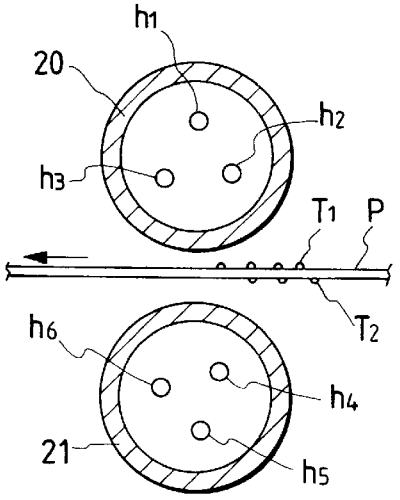
FIG. 3 is a side view showing another example of the toner image heating device, which constitutes a second embodiment of the invention.

In the case of FIG. 3, the heating rollers 20 and 21 are provided spaced a predetermined distance from each other, so that the surfaces of the heating rollers 20 and 21 are not in contact with the toner images $T_1$ and $T_2$. In this case, the heating rollers 20 and 21 are not in contact with the sheet P, it is unnecessary to form the release layers on the surfaces of the heating rollers; that is, the structure of the rollers is simplified as much.

Third Embodiment

Figure 4:
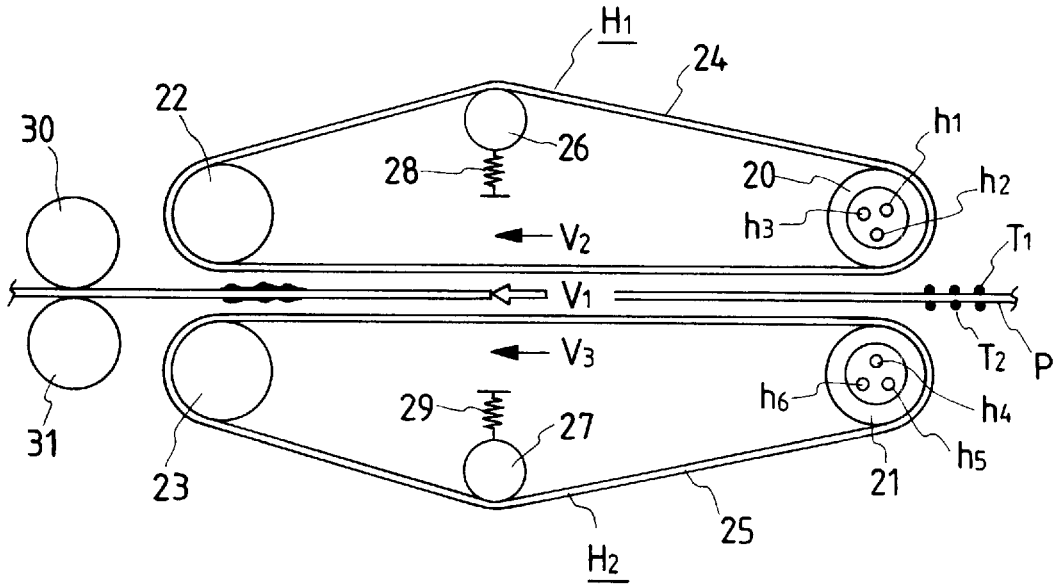
FIG. 4 is a side view showing another example of the toner image heating device, which constitutes a third embodiment of the invention.

In the case of FIG. 4, a third embodiment of the invention, rotors (rotating rollers) 22 and 23 are provided downstream of the heating rollers 20 and 21 as viewed in the direction of conveyance of the sheet, and an endless belt 24 is laid over the heating roller 20 and the rotating roller 22, while an endless belt 25 is laid over the heating roller 21 and the rotating roller 23.

Now, the third embodiment shown in FIG. 4 will be described in more detail.

In FIG. 4, reference numerals 26 and 27 designate rotating rollers; and 28 and 29, tension springs adapted to press the rollers 26 and 27 against the inner surfaces of the endless belts 24 and 25, respectively. Hence, the endless belts 24 and 25 are held being tensioned as required. Furthermore, in FIG. 4, reference numerals 30 and 31 designate sheet conveying rollers. In the following description, for convenience in description, upper heating elements including the heating roller 20, the rotating rollers 22 and 26, the tension spring 28, and the endless belt 24 will be referred to as a heating unit $H_1$, and similarly lower heating elements including the heating roller 21, the rotating rollers 23 and 27, the tension spring 29, and the endless belt 25 will be referred to as a heating unit $H_2$.

The above-described heating units $H_1$ and $H_2$ are so arranged that their endless belt surfaces are confronted with the sheet P. In the case where the heating rollers 20 and 21 are drive rollers, the speeds of conveyance of the endless belts 24 and 25 can be set to a desired value by controlling the speeds of rotation of the heating rollers 20 and 21. The surface temperatures of the endless belts 24 and 25 can be set to desired temperatures by on-off controlling the heaters $h_1$ through $h_6$ of the heating rollers 20 and 21. In the embodiment thus designed, the endless belts 24 and 25 held at predetermined temperatures are driven at desired speeds.

One example of the relation between speed and conveyance in the embodiment, will be described. In the embodiment, the conveyance speed is so determined as to meet $V_1=V_2=V_3$ (where $V_1$ is the conveyance speed of the sheet P, $V_2$ is the conveyance speed of the endless belt 24, and $V_3$ is the conveyance speed of the endless belt 25). In this case, the thermal efficiency is much higher than in the case where a radiation heat source section is fixed as in the case of a conventional flash fixing system or oven fixing system.

Figure 5:
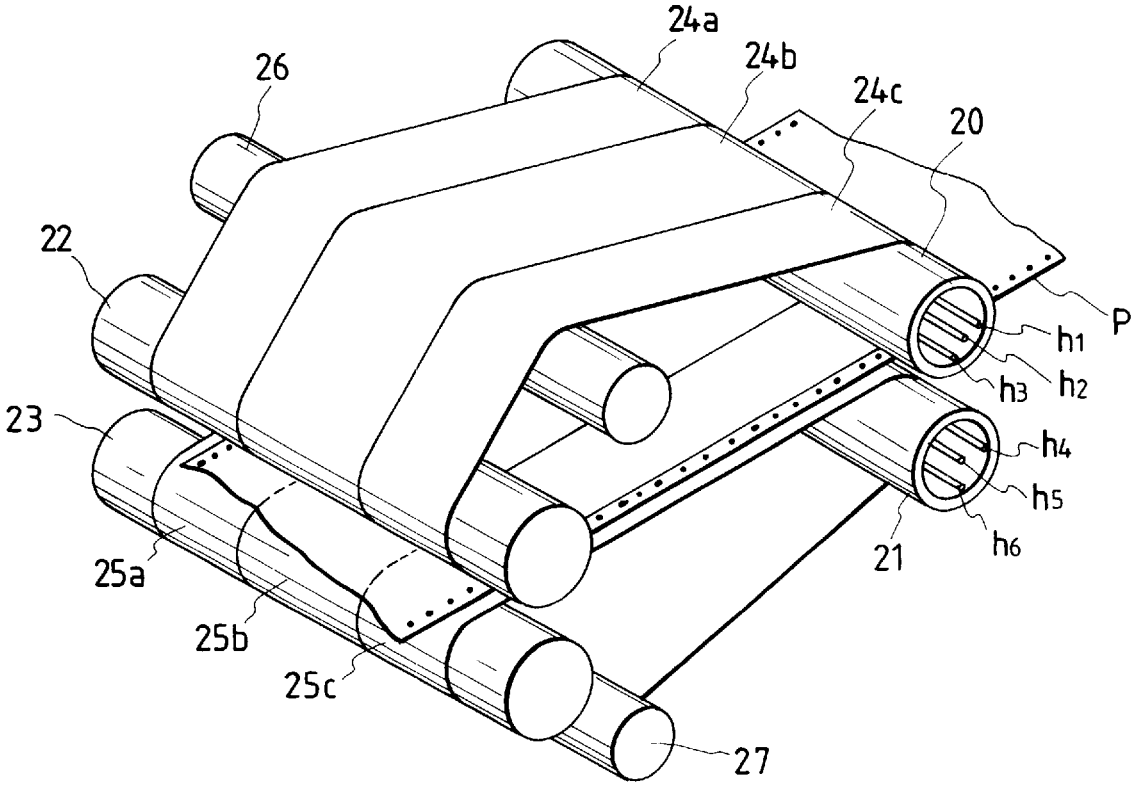
FIG. 5 is a perspective view of the toner image heating device, the third embodiment of the invention.

Each of the endless belts 24 and 25 may be made up of a plurality of endless belts as shown in FIG. 5.

Although the size of a sheet to be used depends on a printer which has been selected, in the case where a printer is taken into consideration which is able to convey sheets of from a size A4 sheet up to a size A3 sheet horizontally, the belts should be able to handle sheets of from 300 mm up to 500 mm. Hence, the endless belts 24 and 25 need a width of at least 500 mm, the maximum width of the sheet. As shown in FIG. 5, the endless belts 24 and 25 are divided into parts 24*a*, 24*b*, 24*c*, and 25*a*, 25*b* and 25*c* in the directions of axes of the heating rollers 20 and 21. This feature makes it possible to decrease the dimensions of each of the endless belts when the latter is formed. Furthermore, the feature contributes to an improvement of manufacturing accuracy and workability, and minimizes the part cost.

Figure 6:
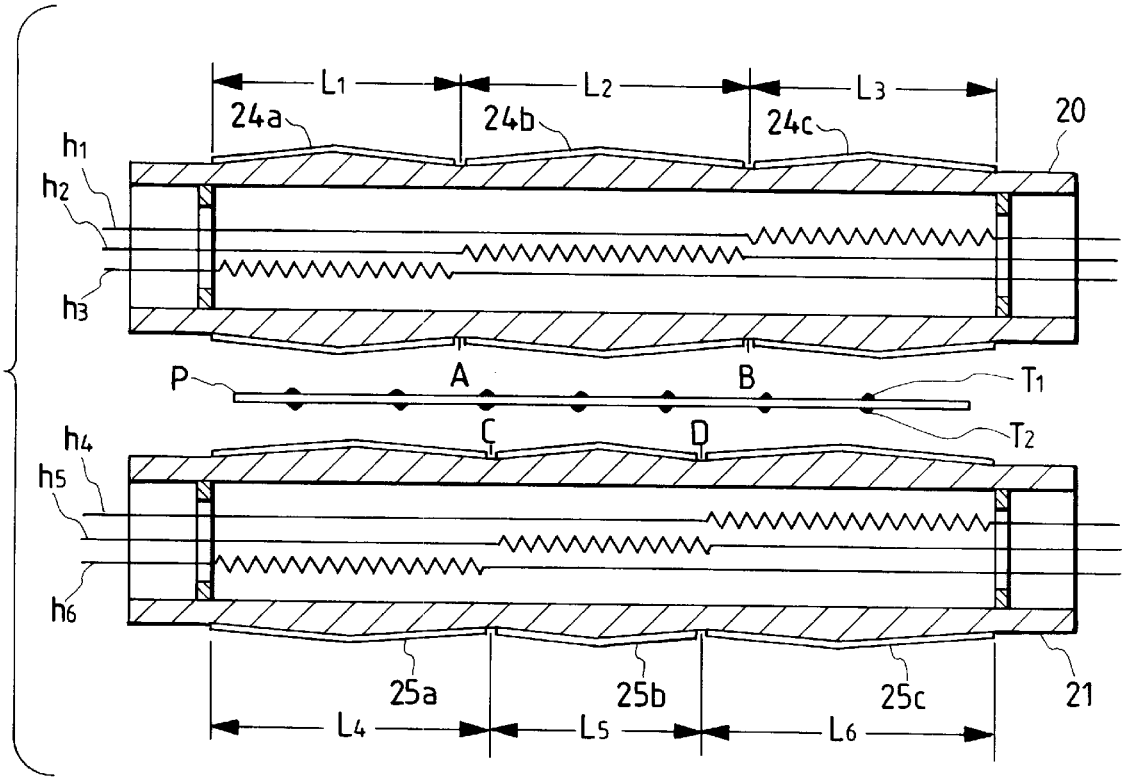
FIG. 6 is a sectional view of the toner image heating device, the third embodiment of the invention.

The endless belts 24 and 25 may be divided in response to the heat generating region dividing positions A and B, and C and D of the heaters h, through $h_6$ as shown in FIG. 6, or they may be divided irrespective of the dividing positions.

By dividing the conveying surfaces of the endless belts 24 and 25 and the heat generating regions of the heating rollers 20 and 21, when a sheet small in width is conveyed, the excessive increase of temperature or the excessive use of the quantity of heat can be eliminated, so as to attribute to the over-heating of the parts of the endless belts where no sheet is present.

In FIG. 6, with respect to the heat generating region dividing positions A and B, and C and D of the heaters $h_1$ through $h_6$, the dividing position D of the heaters $h_4$ and $h_5$ is located on the left of the dividing position B of the heater $h_1$ and $h_2$. Similarly, the dividing position C of the heaters $h_5$ and $h_6$ is located on the right of the dividing position A of the heaters $h_2$ and $h_3$. That is, the dividing positions are shifted from one another. This feature allows the heating rollers 20 and 21 to prevent the decrease in temperature at the dividing positions; that is, the local temperature decrease can be prevented. The dividing positions A and B, and C and D are merely by way of example. The distance between the positions A and B, and the distance between the positions C and D can be set to desired values.

It is preferable that the outer cylindrical surfaces (widths $L_1$ through $L_6$) of the heating rollers 20 and 21 are each in the form of a crown as shown in FIG. 6. More specifically, the outer cylindrical surface of the heater rollers 20 and 21 are each bent in the form of a crown along the center lines of the widths $L_1$, $L_2$ and $L_3$, and $L_4$, $L_5$ and $L_6$ of the divided endless belts 24*a*, 24*b* and 24*c*, and 25*a*, 25*b* and 25*c*. In this case, the endless belts are positively straightly moved on.

In the above-described embodiments, the rotating rollers 22 and 23 are provided downstream of the heating rollers 20 and 21 as viewed in the direction of conveyance of a sheet, and the endless belt 24 is laid over the heating roller 20 and the rotating roller 22, while the endless belt 25 is laid over the heating roller 21 and the rotating roller 23; however, the invention is not limited thereto or thereby. That is, the rotating rollers 22 and 23 may be provided upstream of the heating rollers 20 and 21 as viewed in the direction of conveyance of a sheet.

Each of the toner image heating devices, the first, second and third embodiments, may be employed as a fixing unit which is to finally fix toner images on the recording sheet, or it may be combined with a fixing unit so that it may be employed as a preliminary fixing unit or temporary fixing unit.

Effect(s) of the Invention

As is apparent from the above description, according to the invention, it is possible to provide a toner image heating device the heating region of which, in each of the front and rear surfaces of a recording material, corresponds to the size of a given recording material.

What is claimed is:

1. A toner image heating device for heating a recording material holding a toner image, comprising:

a first heating roller having a plurality of heaters which are different in heat generating region from one another; and a second heating roller having a plurality of heaters which are different in heat generating region from one another, wherein a heat generating region dividing position between said heaters adjacent to each other in said second heating roller is shifted from a heat generating region dividing position between said heaters adjacent to each other in said first heating roller.

2. A toner image heating device as claimed in claim 1, wherein said recording material is conveyed while being held between said first heating roller and said second heating roller which are pressed against each other.

3. A toner image heating device as claimed in claim 1, wherein said recording material is conveyed while passing through said first heating roller and said second heating roller which are spaced a predetermine distance from each other.

4. A toner image heating device as claimed in claim 1, wherein a rotor is provided downstream or upstream of at least one of said first and second heating rollers as viewed in the direction of conveyance of said recording material, and an endless belt is laid over said heating roller and said rotor.

5. A toner image heating device as claimed in claim 4, said endless belt is divided into parts in the direction of axis of said heating roller.

6. A toner image heating device as claimed in claim 5, the outer cylindrical surface each of at least one of said heating roller and rotor includes a crown portion in correspondence to the positions of said divided endless belts.

7. A toner image heating device as claimed in claim 4, wherein said endless belt is divided into parts in correspondence to the number of said heaters in said heating roller.

8. A toner image heating device as claimed in claim 7, the outer cylindrical surface each of at least one of said heating roller and rotor includes a crown portion in correspondence to the positions of said divided endless belts.

9. A toner image heating device for heating a recording material holding an toner image, comprising:

a first heating roller having a plurality of first heaters; and a second heating roller having a plurality of second heaters and confronting with said first heating roller.

10. A toner image heating device as claimed in claim 9, wherein the plurality of first heaters are different in heating generating region from one another, and the plurality of second heaters are different in heating generating region from one another.

* * * * *